US005440527A

United States Patent [19]

Okamoto

[11] Patent Number: 5,440,527

[45] Date of Patent: Aug. 8, 1995

[54] ELECTRONIC TIMEPIECES

[75] Inventor: Tetsushi Okamoto, Iruma, Japan

[73] Assignee: Casio Computer Co., Ltd., Tokyo, Japan

[21] Appl. No.: 340,548

[22] Filed: Nov. 16, 1994

[30] Foreign Application Priority Data

Nov. 22, 1993 [JP] Japan ..... 5-313995

[51] Int. Cl.[6] ..... G04B 19/04; G04B 25/00

[52] U.S. Cl. ..... 368/80; 368/223

[58] Field of Search ..... 368/10, 73, 74, 76, 368/80, 82, 223, 228, 239

[56] References Cited

U.S. PATENT DOCUMENTS 4,257,115 3/1981 Hatuse et al. ..... 368/69
4,388,000 6/1983 Hagihara .
5,202,858 4/1993 Kanzaki .
5,220,539 6/1993 McDuffee ..... 368/28
5,299,177 3/1994 Koch ..... 368/73

*Primary Examiner*—Vit W. Miska
*Attorney, Agent, Firm*—Frishauf, Holtz, Goodman & Woodward

[57] ABSTRACT

An electronic timepiece includes the function of indicating the current time and a plurality of other different functions. Data provided by at least one of the plurality of other different functions is displayed by the turning of a pointer with a pointer display control unit within a predetermined range of angles. Data provided by at least one of the other functions is displayed on an electro-optical display. While data provided by the at least one of the other functions is being displayed on the electro-optical display, a function designating control unit moves the pointer to a predetermined position outside the predetermined range of angles to indicate the at least one of the function.

19 Claims, 10 Drawing Sheets

FIG.3

| | |
|---|---|
| M | SF |
| GP | NP |
| OF | |
| ALARM TIME AT | |

ELECTRONIC TIMEPIECES

BACKGROUND OF THE INVENTION

The present invention relates to electronic timepieces having the function of recording/indicating the current time as well as a plurality of other functions.

Recent electronic timepieces have been multi-functionized such that they have the function of recording-/indicating the current time as well as the functions of a stopwatch, timer, alarm, etc., and respectively select and display data provided by those functions in digital indicator segments on an electro-optical display device.

When data provided by such multi-functions are respectively selected and displayed, the selected data must be indicated clearly.

For example, U.S. Pat. No. 4,388,000 discloses an electro-optical display device which has many indicators corresponding to those functions which are selectively lighted up to clearly and selectively indicate the information provided by those respective functions.

Since a small electronic timepiece such as an electronic wrist watch is limited in size, the function indicators, if any, are reduced in size and hence cannot be recognized well.

The other functions of the electronic wrist watch include a timer function; that is, a down counter in which a predetermined time is set beforehand starts a count-down operation with a start command to thereby display the remaining gradually decreasing time until the set timer time is reached. The conventional down timer function, however, only displays the remaining time.

In order to clearly inform the user of the remaining time decreasing gradually to 0 or to cause the user to easily recognize a proportion of the remaining time to the predetermined set timer time in the down timer function, a rotational pointer is preferably provided so as to rotate with the time elapsed since a starting point of time to display the remaining time.

However, provision of a pointer indicator only to display the remaining timer time is not recommendable and is useless from a standpoint of effective use of a space and the components of the timepiece.

SUMMARY OF THE INVENTION

It is therefore an object of the present invention to provide an electronic timepiece in which one element having a function, for example, a pointer provided for indication of the remaining time in the timer function, is usable effectively for indication of other information provided by the corresponding one of the other various functions.

In order to achieve the above object, the present invention provides an electronic timepiece comprising:

current time display function means for displaying the current time;

a plurality of other function means different from the current time display function means for providing a plurality of different data;

pointer means;

pointer display control means for turning pointer means within a predetermined range of angle to display data provided by first at least one of said plurality of other function means;

electro-optical display means for displaying data provided by second at least one of the plurality of other function means different from the first at least one of the plurality of other function means; and when the electro-optical display means displays data provided by the second at least one of the plurality of other function means, function specifying control means for moving the pointer means to a predetermined position outside the predetermined range of angle to specify the function of the second at least one of the plurality of other function means.

According to the electronic timepiece of the present invention, the pointer means provided for indication of data provided by one of the other functions is usable for indication of a further other function which provides data displayed by the electro-optical display means when the pointer means indicates no data provided by the one of the other functions to thereby achieve effective use of a space and the components of the timepiece.

BRIEF DESCRIPTION OF THE DRAWINGS

FIG. 3 shows the structure of a RAM of the electronic timepiece;

DESCRIPTION OF THE PREFERRED EMBODIMENT

Figure 1:
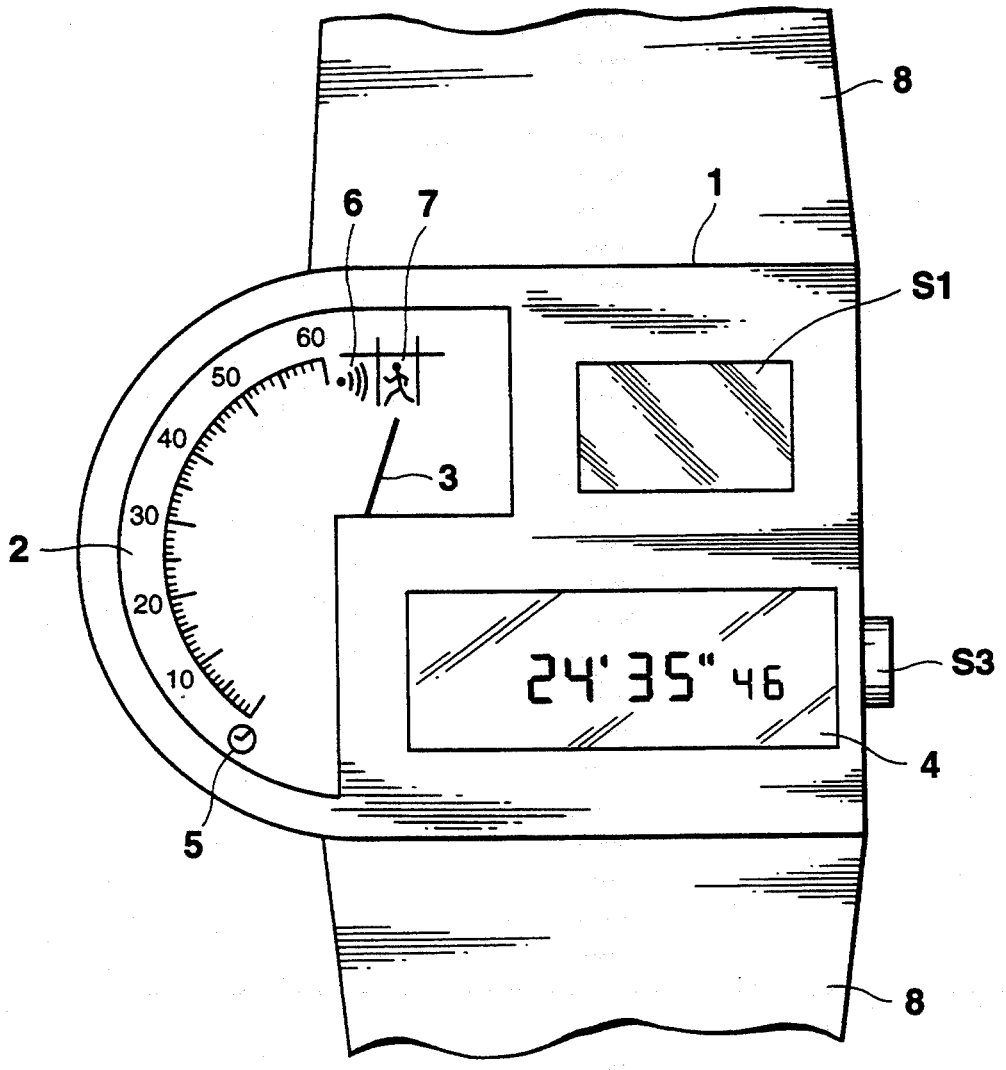
FIG. 1 shows the appearance of one embodiment of an electronic timepiece according to the present invention.

An electronic timepiece of one embodiment of the present invention will be described with respect to FIGS. 1–8. FIG. 1 shows the appearance of the electronic timepiece. The electronic timepiece includes a case 1 which has a front left-hand semi-circular portion in which a pointer display 2 with a pointer 3 is provided. The timepiece has a switch S1 in an upper right-hand portion thereof, a digital liquid crystal display 4 below the switch S1, a switch S3 on the right-hand side of the case 1. The pointer 3 can point out a position representing any value in a range of step values of 0–70 with scales of 0, 10, 20, 30, . . . 60 indicating the corresponding minutes and step values being printed.

In addition, at the position of the step value of 0, a designed pointered timepiece mark 5 is printed. At the position of the step value of 65, a designed alarm sound mark 6 is printed. At the position of the step value of 70, a stopwatch mark 7 indicating a designed runner image is printed.

Wrist bands 8 are attached to the timepiece at 12 and 6 o'clock for wearing purposes.

Figure 2:
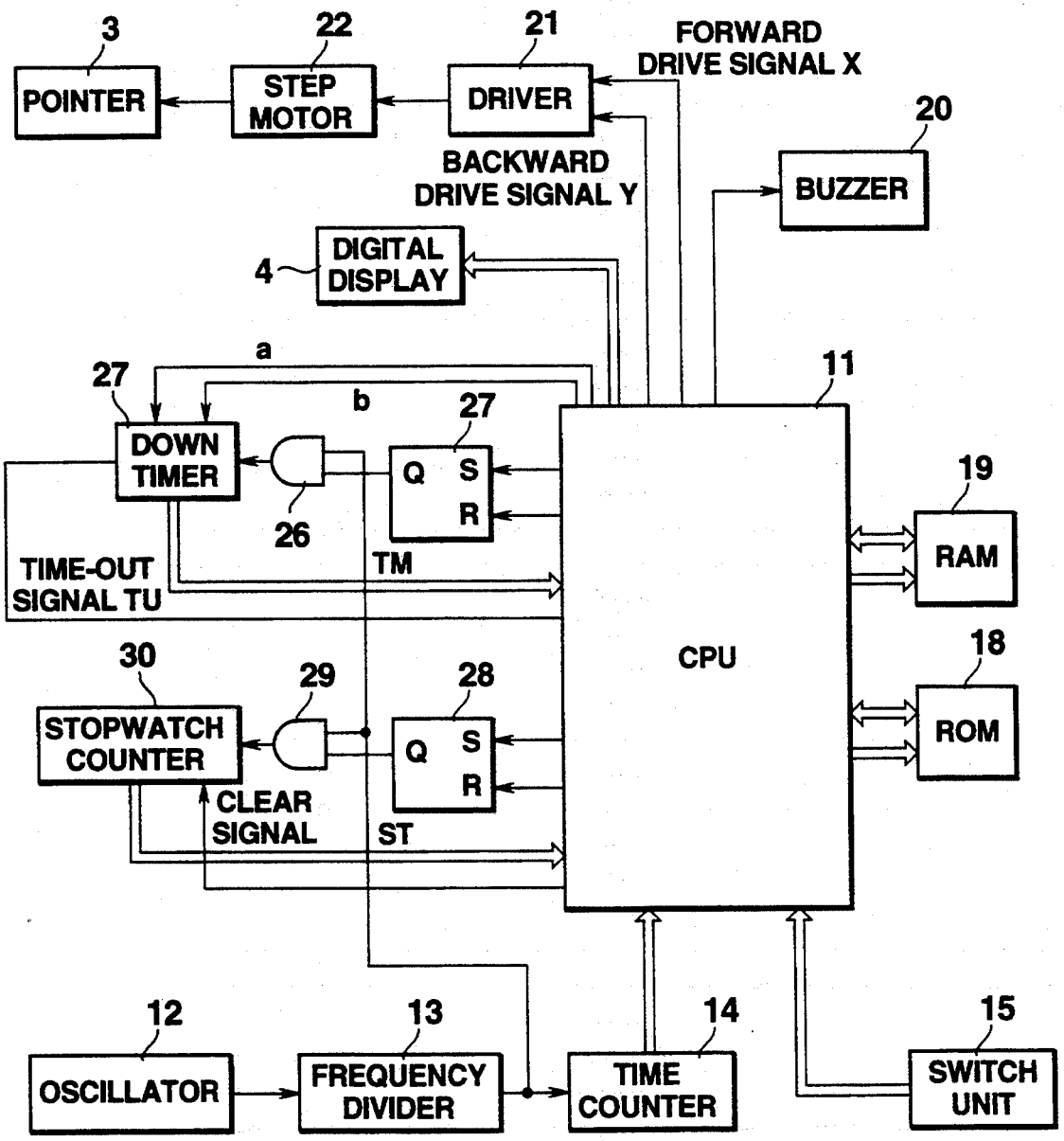
FIG. 2 shows a circuit construction of the electronic timepiece.

FIG. 2 shows the circuit construction of the electronic timepiece. In FIG. 2, a CPU 11 is connected to other elements of the timepiece. The CPU 11 receives, processes and delivers data to the elements concerned and delivers control signals to the elements concerned for controlling purposes.

An oscillator 12 generates a constant frequency signal normally. A frequency divider 13 divides the signal from the oscillator 12 to provide a signal of 1 Hz, which is delivered to a time counter 14, and AND gates 29 and 26. The time counter 14 counts signals of 1 Hz from the frequency divider 13 to obtain the current time data (on the current month, date, day of the week, hour, minute, second) and delivers this data to the CPU 11.

The switch unit 15 includes a plurality of switches (to be described later). When any one of those switches is operated, a corresponding switch signal is delivered to the CPU 11.

A ROM 18 stores programs on the respective operations of the timepiece in a fixed manner and delivers stored programmed instructions, etc., sequentially to the CPU 11 under control of same.

A RAM 19 has a structure (to be described later) and stores data from the CPU 11 and delivers stored data to the CPU 11 under control of same.

A buzzer 20 receives a control signal from the CPU 11 to generate a reporting sound for a predetermined duration of time. A driver 21 receives a forward drive signal X or a backward drive signal Y from the CPU 11 to drive a step motor 22 forward or backward to move the pointer 3, which includes a single needle to indicate data on the remaining time TM delivered from a down timer 27 (to be described later). A digital display 4 displays data from the CPU 11.

An RS flip-flop 25 receives a signal from the CPU 11 to be set or reset. In the set state, the flip-flop 25 generates an output Q. The AND gate 26 is opened with the output Q from the flip-flop 25 to deliver a signal of 1 Hz from the frequency divider 13 to the down timer 27.

The down timer 27 receives a +1-minute signal a or a −1-minute signal b from the CPU 11 to change its set time sequentially to a timer time incremented or decremented by one minute; decrements the set timer time (or remaining time TM) by one second each time it receives the signal of 1 Hz through the AND gate 26; delivers data on the remaining time TM normally to the CPU 11 and, when the remaining time TM reaches 0, delivers a time-out signal TU to the CPU 11.

The RS flip-flop 28 receives a signal from the CPU 11 to be set or reset. In the set state, the flip-flop 28 generates an output Q. The AND gate 29 is opened with the output Q from the flip-flop 28 to deliver a signal of 1 Hz from the frequency divider 13 to the stopwatch counter 30. The stopwatch counter 30 counts signals of 1 Hz through the AND gate 29 to obtain elapsed time data or stopwatch time data ST, delivers same to the CPU 11, and receives a clear signal c from the CPU 11 to clear the counted stopwatch time data ST therein.

FIG. 3 shows the structure of the essential portion of the RAM 9. A mode register M designates a mode. When the set value is 0, the mode register M designates a timepiece mode in which the current time data in the time counter 14 is displayed on the digital display 4. When the set value is 1, the mode register M designates a timer mode in which the timepiece is used as a down timer. When the set value is 2, the mode register M designates an alarm mode in which an alarm time is set. When the set value is 3, the mode register M designates a stopwatch mode in which the timepiece is used as the stopwatch. A start flag SF is set at 1 when the down timer 27 is operating in the timer mode. A pointer position register GP is a one in which a step value indicative of the position which the pointer 3 actually points out is set.

A destination register NP is a one in which a step value indicative of the position of a destination is set when the pointer 3 is to be moved to its position.

An addition/subtraction designating register OF designates as such one of a timer time incremented by one minute and a timer time decremented by one minute (which of the +1-minute signal a or the −1-minute signal b should be delivered to the down timer 17 to provide a desired timer time), each time the switch is operated. An alarm time register AT stores data on an alarm time set by a switch in the alarm mode.

The operation of the electronic timepiece of the embodiment will be described next with respect to a general flowchart of FIG. 4 indicative of the summary of the operation of the timepiece. First, at step S1 the CPU determines a designated mode on the basis of a value in the mode register M. When the value in the mode register M is 0 and hence the timepiece mode has been designated, control passes to step S2, where the CPU performs a timepiece mode process; when the value in the mode register M is 1 and hence the timer mode has been designated, control passes to step S3, where the CPU performs a timer mode process; when the value of the mode register M is 2 and hence the alarm mode has been designated, control passes to step S4 in which the CPU performs an alarm mode process; when the value in the mode register M is 3 and hence the stopwatch mode has been designated, control passes to step S5, where the CPU performs a stopwatch mode process.

After the process at one of steps S2–S5, control passes to step S6, where the CPU checks whether the current time, data on which is stored in the time counter 14, has reached an alarm time, data on which is stored in the alarm time register AT in the RAM 19. If so, control passes to step S7, where the CPU performs a reporting time process in which a control signal is delivered to the buzzer 20 to cause same to generate a reporting sound for a predetermined duration of time. Control then passes to step S8. If the alarm time is not reached at step S6, control passes from step S6 directly to step S8.

At step S8 the CPU determines whether the value of the start flag SF is 1 or the down timer 27 is in operation. If so, control passes to step S9, where the CPU determines whether it has received a time-out signal TO from the down timer 27 or whether the remaining time TM in the down timer 27 has reached 0. If so, control passes to step S10, where the CPU delivers a control signal to the buzzer 20 to perform a reporting process in which a reporting sound is generated for a predetermined duration of time (a control signal at step S10 is different from the control signal delivered to the buzzer 20 in the reporting process at step S7, so that the reporting sound generated from the buzzer 20 at step S10 has a different tone from that generated at step S7).

At step S11 the CPU sets the start flag SF at 0. Control then passes to step S12, where the CPU delivers a reset signal to the RS flip-flop 25 to reset same to stop the delivery of the output Q from the flip-flop 25 to thereby close the AND gate 26 and hence stop the down timer 27.

(1) When the process at step S12 ends; (2) when the CPU determines at step S8 that the start fag SF is not 1; or (3) when the CPU determines at step S9 that it has not yet received a time-out signal TO, control returns to step S1, where the CPU iterates the operations at steps S1–S8, S9 mentioned above.

Figure 4:
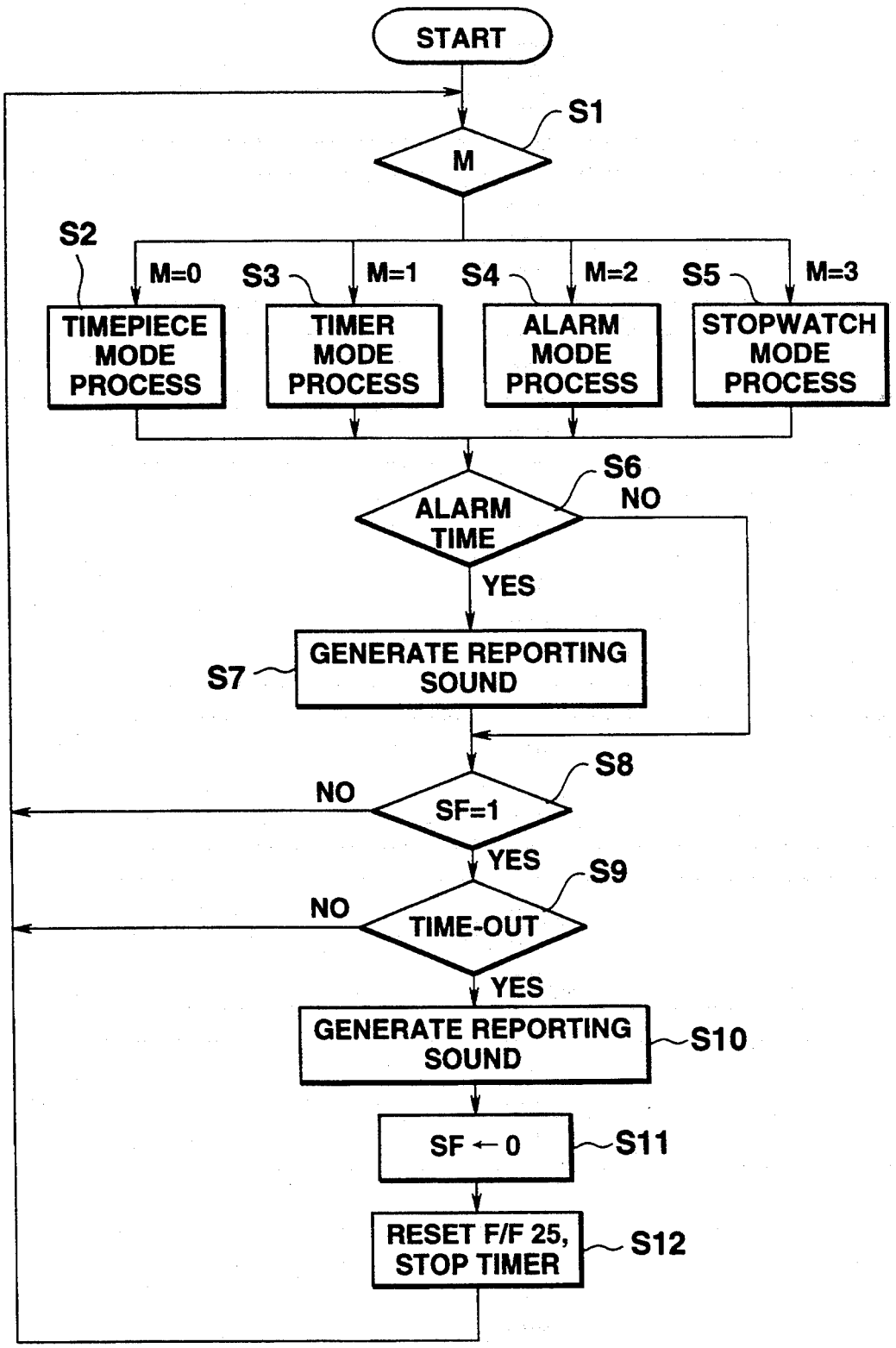
FIG. 4 is a general flowchart indicative of the summary of the operation of the electronic timepiece.
Figure 5:
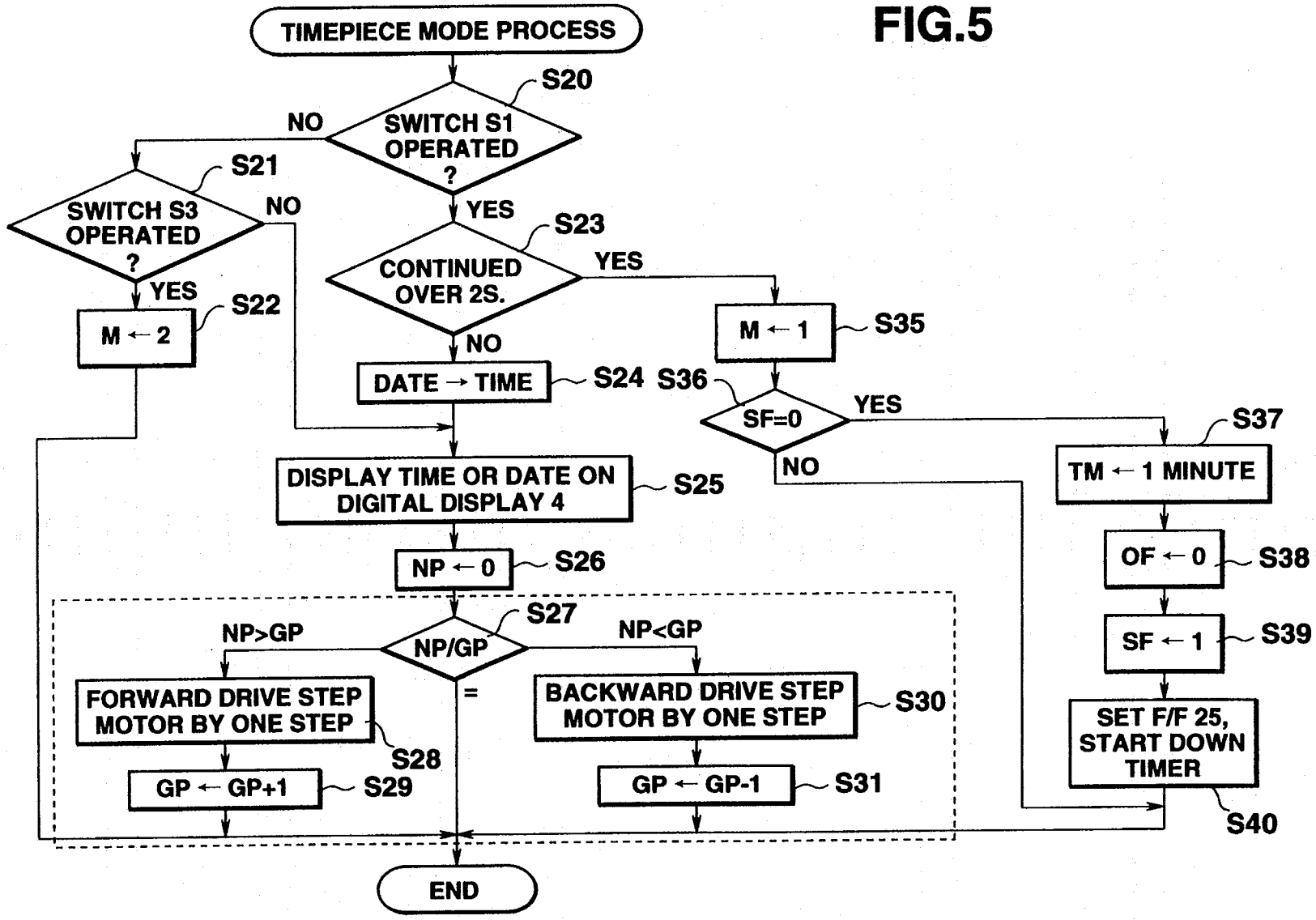
FIG. 5 is a flowchart indicative of the details of a timepiece mode process of FIG. 4.
Figure 6:
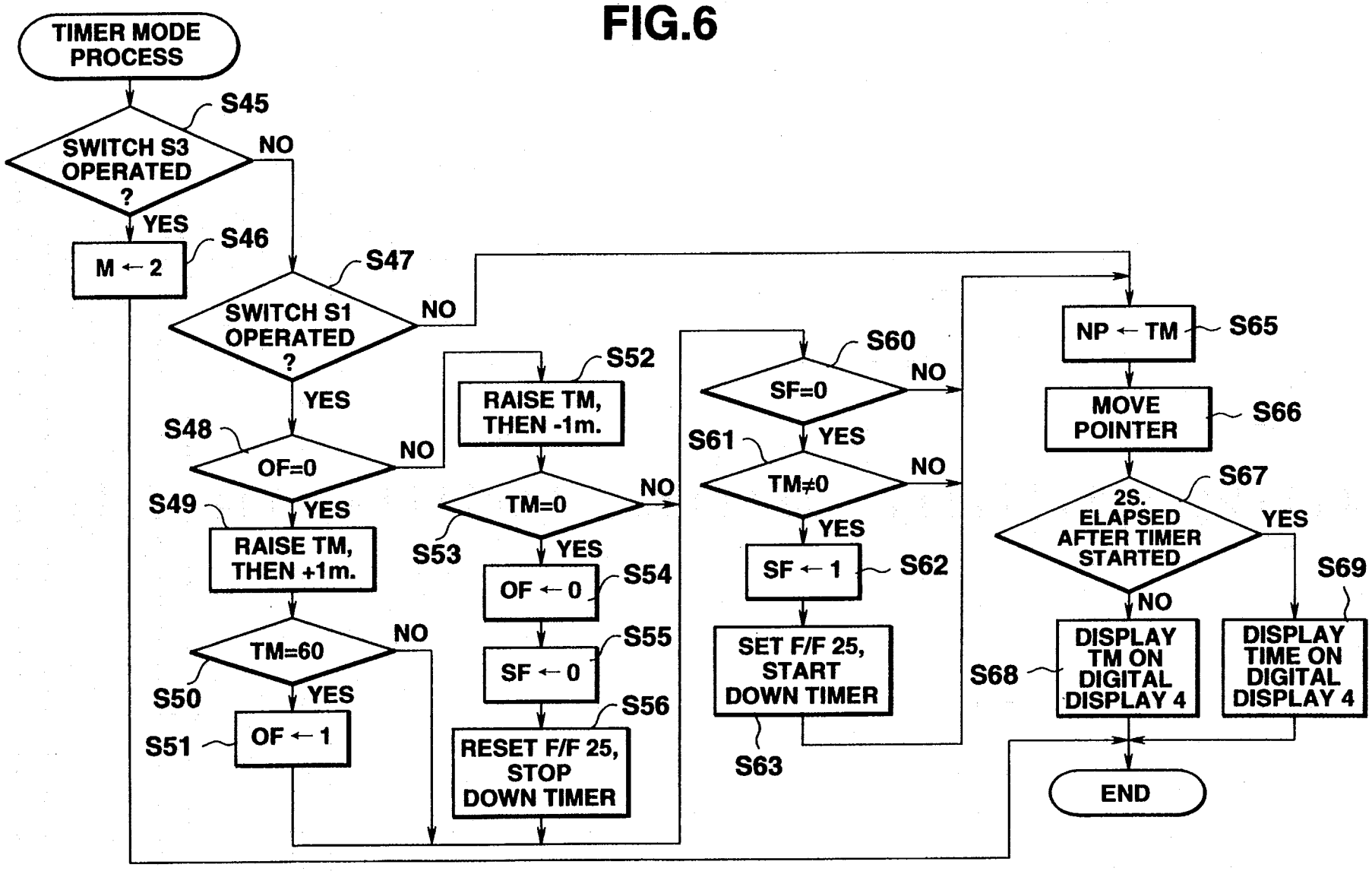
FIG. 6 is a flowchart indicative of the details of a timer mode process of FIG. 4.
Figure 7:
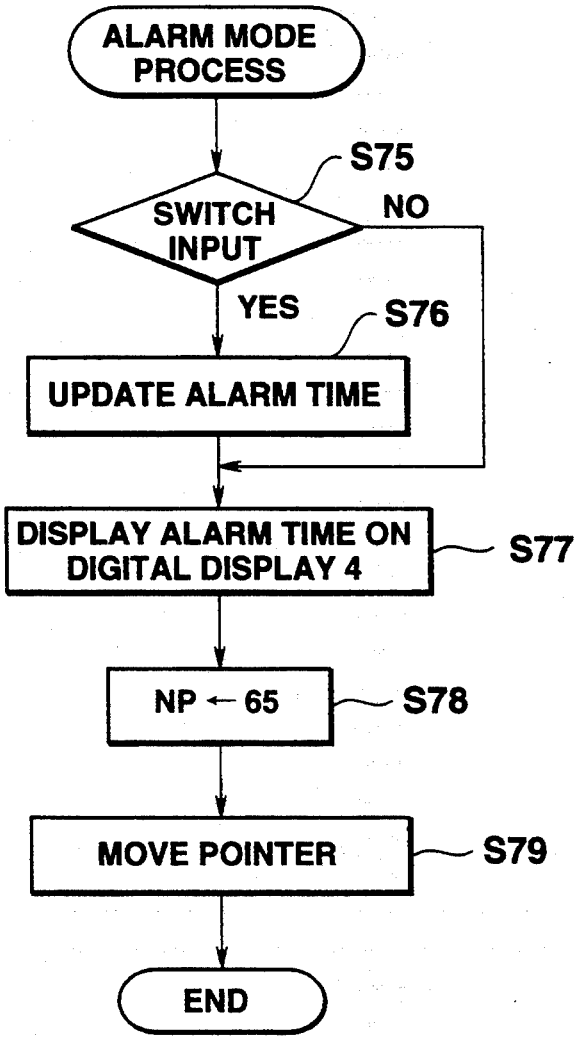
FIG. 7 is a flowchart indicative of the details of an alarm mode process of FIG. 4.

FIG. 5 is a flowchart indicative of the details of the timepiece mode process of FIG. 4 at step S2 of FIG. 4. FIG. 6 is a flowchart indicative of the details of the timer mode process at step S3. FIG. 7 is a flowchart indicative of the details of the alarm mode process at step S4.

Referring to those flowcharts, the operations of the timepiece will be described below in detail.

Figure 8:
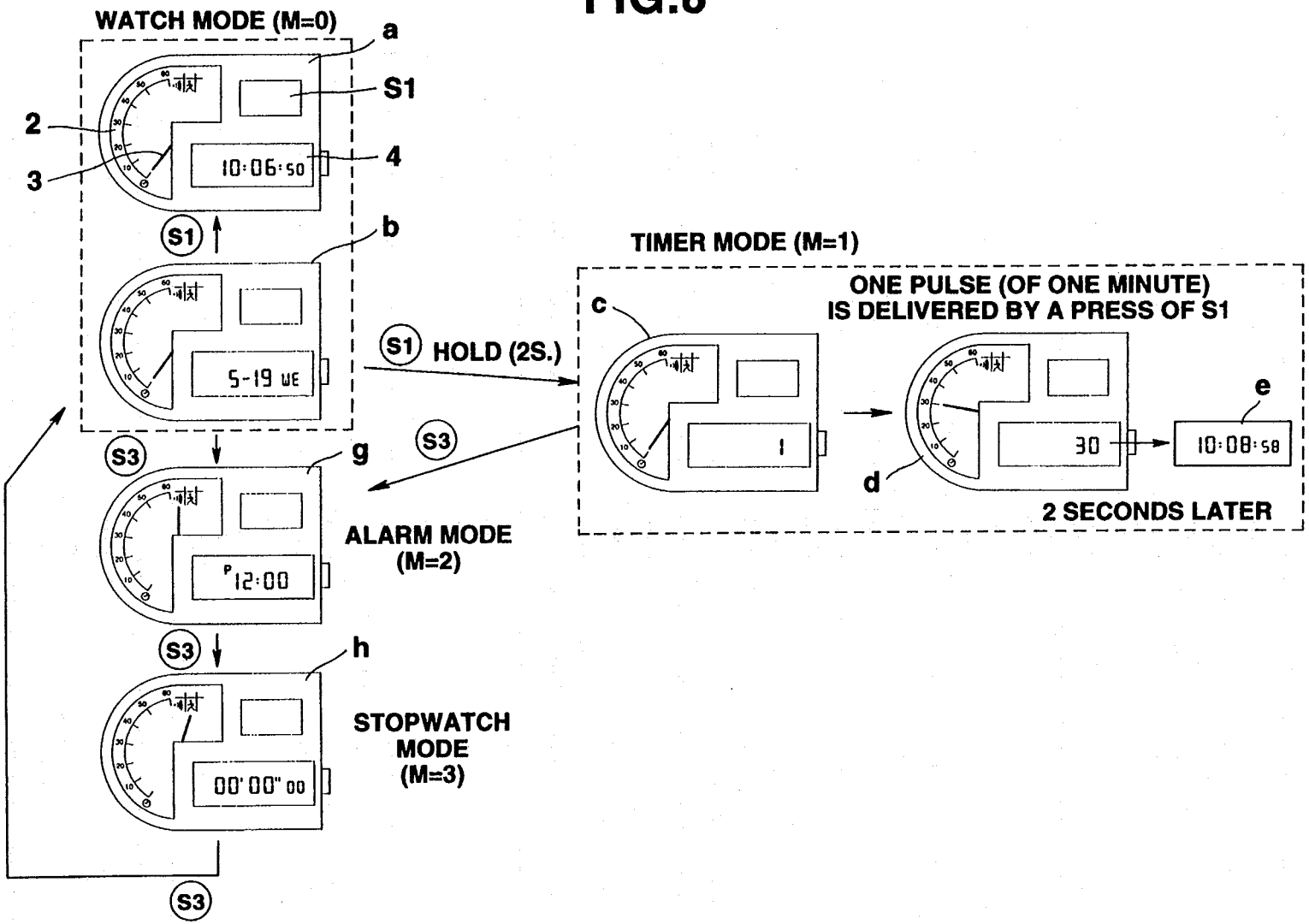
FIG. 8 shows a changing display in the electronic timepiece of FIG. 1.

(a) In the timepiece mode:

For example, assume now that the timepiece is in a state a of FIG. 8 in the timepiece mode. In this case, so long as no switch is operated, the CPU determines that the value of the mode register M is 0 at step S1 of FIG. 4, and that the timepiece mode process has been employed at step S2. Thus, control passes to step S2 involving the timepiece mode process shown by the flowchart of FIG. 5.

The CPU then determines that no switch S1 has not been operated at step S20. Control then passes to step S21, where the CPU determines that the switch S3 has not been operated.

Control then passes to step S25, where the CPU displays the time data (on hour, minute and second alone, in this case) in the time counter 14 or date data designated at that time on the digital display 4. Control then passes to step S26, where the CPU sets 0 in the destination register NP such that the pointer 3 points out the timepiece mark 5 implying that the timepiece mode is set now. Control then passes to steps 27–31 involving a pointer moving process (shown by a block enclosed by a dotted line in FIG. 5).

First, at step S27 the CPU compares the step value of the destination register NP with that of the pointer position register GP. In this case, since the timepiece mode has been employed already, both the step values are equal (together 0), so that no movement of the pointer 3 occurs (the pointer 3 remains pointing to the timepiece mark) to thereby end the timepiece mode process. Thereafter, the CPU performs the process at step S6–S12 of FIG. 3, as mentioned above. Control then returns to step S1, where the CPU performs the subsequent operations again.

For example, assuming now that the time data in the time counter 14 is 10 (h): 06 (m): 50 (s), and the display of this time data is designated, the time data is displayed on the display 4 at step S25, as shown by a in FIG. 8.

In order to change the display state from the above state (where the hour, minute, and second data on the current time are displayed on the display 4, as shown by a in FIG. 8) to the state where data on the current date is displayed on the digital display 4, the switch S1 of FIG. 8 is operated. At this time, the CPU detects this operation at S20 of FIG. 5. At step S23 the CPU determines that the operation of the switch S1 is a general one and does not continue over two seconds. Control then passes to step S24, where the CPU switches the data to be displayed from the time data to the date data. Control then passes to step S25, where the CPU displays new target date data in the time counter 14 on the display 4.

At step S26 the CPU sets a set value of 0 in the destination register NP. At the next step S27 the CPU determines that the destination register NP is equal in set value to the pointer position register GP to end the timepiece mode process. Control then passes to step S6 of FIG. 4, where the CPU performs the subsequent operations. For example, if the date data counted by the time counter 14 is 5 (May)-19 (Wednesday), the digital display 4 displays that data, as shown by b in FIG. 8.

In order to recover the time display state after the date data is displayed on the display 4, the switch S1 is operated. Also, in this case, at step S20 of FIG. 5 the CPU detects this operation. Control then passes through step S23 to step S24, where the CPU switches the data to be displayed to the time data. Then, at step S25 the CPU displays the time data on the digital display 4. Then, the CPU performs processes at steps S26–S27 to thereby end the timepiece mode process. Control then returns to the state shown by a in FIG. 8.

(b) In the time mode:

In order to change the mode from the timepiece mode to the timer mode, as shown in FIG. 8, the switch S1 continues to be depressed over two seconds. In this case, first, at step S20 of FIG. 5 the CPU detects the operation of the switch S1. At step S23 the CPU determines that the switch S1 continued to be depressed for over two seconds.

Control then passes to step S35, where the CPU sets the mode register M at 1 to designate the timer mode. At step S36 the CPU determines that the value of the start flag SF is 0 and the down timer 27 has not yet started. Control then passes to step S37, where the CPU delivers one pulse of a +1-minute to the down timer 27 to set one minute in the down counter 27 as its remaining time TM.

At step S38 the CPU then sets the count up/down designating register OF at 0 to store that a state is set in which the remaining time TM in the down timer 27 is incremented by one minute by the operation of the switch S1. At step S39 the CPU sets the start flag SF at 1 to store starting the timer operation of the down timer 27.

Then, at step S40 the CPU sets the RS flip-flop 25 to open the AND gate 26 through which a signal of 1 Hz from the frequency divider 13 is delivered to the down timer 27 to thereby start its timer operation actually.

Thereafter, the CPU performs the process at step S6–S9 of FIG. 4. Control then returns to step S1, where the CPU determines that the value of the mode register M is already 1 and hence the timer mode has already been employed. Control then passes to step S3 or a timer mode process of FIG. 6.

Control passes through steps S45, S47 to step S65, where the CPU sets in the destination register NP the remaining time TM (in this case, one minute, as mentioned above) set in the down timer 27 as a step value for a position which the pointer 3 should point to. Control then passes to step S66, where the CPU performs the pointer moving process which is similar to that (enclosed by a dotted line) involving steps S27–S31 of FIG. 5. That is, first, at step S27 the CPU compares the destination register NP in step value with the pointer position register GP to determine that the destination register NP is larger in step than the register GP. Thus, the CPU delivers a forward drive signal X to the driver 11 at step S28 to forward drive the step motor 22 by one step and advance the pointer 3 by one step or one minute. Control then passes to step S29, where the CPU increments the step value of the pointer position register GP by one to store the position which the pointer 3 points out.

Thereafter, control passes to step S67 of FIG. 6, where the CPU determines that two seconds has not yet elapsed since the start of the operation of the down timer 27. At step S68 the CPU displays the remaining time TM (in this case, one minute) in the down timer 27 on the display 4.

When the timer mode process (FIG. 6) ends in the manner mentioned above, control passes through steps S6–S9, S1 of FIG. 4 to the timer mode process again. Control then passes through steps S45, S47, S65 to step S66 (pointer moving process involving a portion enclosed by a dotted line in FIG. 5). In this case, at step S27 the CPU determines that the destination register NP is equal in step value to the pointer position register GP (That is, the pointer 13 has already pointed to the target position). Control then passes to step S67, S68 of FIG. 6. By the above processing, the pointer display 2 and the digital display 4 display data, as shown by c in FIG. 8. That is, in the pointer display 2, the pointer 3 points out the remaining time TM or one minute while the digital display 4 digitally displays one minute.

As mentioned above, in order that the CPU may set one minute as the remaining time TM in the down timer 27 and then sets a longer remaining time TM in the down timer 27, the switch S1 is operated successively without putting any interval of time of more than one minute between two adjacent switch operations.

At this time, each time the switch S1 is operated, the CPU detects this operation at step S47 of the timer mode process (FIG. 6), confirms at step S48 that the addition/subtraction designating register OF is 0, raises numeral data in the remaining time TM at the place of a second in the down timer 27 to the place of minute (for example, when the remaining time TM is 40 seconds, the CPU raises that data at the place of a second to one minute. When the remaining time is one minute and twenty seconds, the CPU raises that data at the place of minute to two minutes), and then increments the remaining time TM by one minute at step S49.

At step S50 the CPU determines whether the remaining time TM in the down timer 27 has reached 60 minutes. If not, at step S60 the CPU determines that the value of the start flag SF is not 0, and performs processes at steps S65–S68 in a manner similar to that mentioned above. For example, when the switch S1 is operated 30 times, inclusive of the first operation (continuing for two seconds in the mode switching operation), the CPU sets data on 30 minutes as the remaining time TM in the down timer 27 to thereby display the 30 minutes with the pointer on the pointer display 2 and digitally on the digital display 4, as shown by d in FIG. 8.

When the switch S1 is operated as mentioned above to set the timer time in the down timer 27 and switch S1 then is left unoperated over two seconds, the CPU detects this fact at step S67 in the timer mode of FIG. 6. Control then passes to step S69, where the CPU displays the current time of the time counter 14 on the digital display 4 (in this case, hour, minute, second data).

For example, when the current time is 10 (h): 8 (m): 58 (s), the digital display 4 is as shown by e in FIG. 8. When a target timer time is set in the down timer 27, the decrementing operation of the down timer 27 starts, so that the timer time is displayed on the pointer display 2 and the digital display 4. Then, after a lapse of 2 seconds, the current time is displayed on the digital display 4.

In the above operation, the switch S1 is operated successively such that a time of less than 60 minutes is set as the timer time in the down timer 27. When the switch is operated successively and repeatedly 60 times without any excess interval of time being interposed between any adjacent switch operations such that the timer time in the down timer 27 reaches 60 minutes, the CPU detects this fact at step S50 of FIG. 6. At step S51 the CPU then sets the value of the addition/subtraction designating register OF at 1 to thereby store decrementing the timer time of the down timer 27 one minute by one minute by the subsequent successive operations of the switch S1.

Thereafter, the CPU performs the processes at steps S60, S65–S68, in a manner similar to that mentioned above. Each time the switch S1 is further operated after the timer time reaches 60 minutes, the CPU detects this operation at step S47 of FIG. 6, and determines at step S52 that the addition/subtraction designating register OF is set not at 0 but at 1.

Control then passes to step S52, where the CPU raises numerical data at the place of a second of the remaining time TM (for example, when the remaining time TM is 59 (m): 20 (s), the CPU raises this remaining time TM to 60 minutes, in a manner similar to that mentioned above). The CPU then decrements the remaining time TM or the timer time by one minute, and determines whether the timer time has reached 0 at step S53. If not, control passes to steps S60, S65–S68 to display the timer time in the down timer 27 on the pointer display 2 and the digital display 4. In this case, in the pointer moving process at step S66 the CPU performs the processes at steps S27, S30, S31 of FIG. 5 and hence the pointer 3 points out the timer time sequentially decremented one minute by one minute.

When the switch S1 is operated successively as mentioned above until the timer time reaches 0 minutes, the CPU detects this fact at step S53, returns the value in the addition/subtraction designating register OF to 0 and sets the value of the start flag SF at 0 at step S55 to store stopping the down timer 27. At step S56 the CPU resets the RS flip-flop 25 to stop the timer operation of the down timer 27. Then, control passes to steps S60, S61, S65–S68. That is, when the switch S1 is operated to set 0 minutes as the timer time in the down timer 27, the timer operation of the down timer 27 stops automatically.

In order to start the timer operation of the down timer 27 again after the timer time has been set at 0 minutes by the operation of the switch S1 and hence the timer operation of the down timer 27 has stopped, the switch S1 is operated.

At this time, the CPU detects this operation at step S47 of FIG. 6, and determines that the addition/subtraction designating register OF is at 0 at step S48. Control then passes to step S49, where the CPU sets one minute as the timer time in the down timer 27 to perform processes at steps S50, S60 in a manner similar to that mentioned above. Control then passes to step S61, where the CPU confirms that the timer time is not 0 minutes (in this case, the timer time is one minute due to the above processes). At step S62, the CPU sets the value of the start flag SF at 1 to store starting the timer operation of the down timer 27. Control then passes to step S63, where the CPU delivers a set signal to the RS flip-flop 25 to put same in a set state to thereby start the timer operation of the timer 27.

Thereafter, control passes to steps S65–S68, where the CPU performs corresponding operations. When the CPU sets a time of more than one minute as the timer time in the down timer 27, the operation of the switch S1 is iterated in a manner similar to that mentioned above.

In this case, the CPU performs the processes at steps S47–S50, S60, S65–S68 of FIG. 6 each time the switch S1 is operated, so that the remaining time TM is incremented by one minute and the resulting remaining time TM is displayed on the pointer display 2 and the digital display 4. As in the above operation, when the switch S1 is operated to set a desired timer time in the down timer 27, that is, when the operation of the switch S1 has ended, the down timer 27 starts the timer operation. Two seconds later, the CPU changes data to be displayed on the digital display 4 from data on the timer time or remaining time TM to data on the current time (step S69 of FIG. 6).

After the down timer 24 starts its timer operation and two second further has elapsed in the above manner, the CPU displays the momentarily decrementing remaining time TM on the pointer display 2 and the current time on the digital display 4 digitally. When the time has elapsed until the value of the remaining time TM in the down timer 27 reaches 0 minutes, the down timer 27 generates a time-out signal TO.

The CPU detects the time-out signal TO at step S9 of FIG. 4. Then, control passes to step S10, where the CPU delivers a control signal to the buzzer 20 to perform a reporting sound process in which the timepiece generates for a predetermined duration of time a sound reporting that the remaining time TM has reached 0 minutes. Then, at step S11 the CPU changes the value of the start flag SF to 0 to store stopping the timer operation of the down timer 27. At step S12 the CPU delivers a reset signal to the RS flip-flop 25 to place same in a reset state to stop the timer operation of the down timer 27.

(c) In the alarm mode:

In order to change the mode to the alarm mode, the switch S3 is operated in the timepiece mode or in the timer mode, as shown in FIG.8. When the switch S3 is operated in the timepiece mode, the CPU detects this operation at step S21 of FIG. 4 and changes the value of the mode register M to 2, which implies an alarm mode, at step S22.

When the switch S3 is operated in the timer mode, the CPU detects this operation at step S45 of FIG. 6 and changes the value of the mode register M to 2, which implies an alarm mode, at step S46.

After the alarm mode has been set in the above manner, the CPU determines at step S1 of FIG. 4 that the value of the mode register is 2 and hence that the alarm mode has been set. Control then passes to step S4 or an alarm mode process of FIG. 7. At step S75 the CPU determines whether a new switch input has occurred. If not, control passes to step S77, where the CPU displays the alarm time set in the alarm register AT on the digital display 4. At step S78 the CPU sets a step value of 65 corresponding to the position of the alarm mark 33 in the destination register NP in order to cause the pointer 3 to point out the alarm mark 33 to thereby indicate that the alarm mode has been employed.

Thereafter, at step S79 the CPU performs a pointer moving process or the process (enclosed by a dotted line) at steps S27–S31 of FIG. 5. More specifically, at step S27 the CPU compares the destination register NP in step value with the pointer position register GP. When the CPU determines that the destination register NP is greater in step value than the pointer position register GP, it generates a forward drive signal X to the driver 21 to drive the step motor 23 and the pointer 3 forward by one step at step S28, and increments the step value of the pointer position register GP at step S29 by one to store the position of the forward driven pointer 3 to thereby end the pointer moving process or the process at step S79 of FIG. 7. Thereafter, control passes through steps S6, S8, S1 of FIG. 4 to step S4 or the alarm mode process of FIG. 7 to drive the pointer 3 forward by one step. Processes (steps S75–S79) similar to those mentioned above are then iterated. At this time, in the pointer moving process at step S79 of the alarm mode process, the pointer 3 forward drives one step by one step until the destination register NP becomes equal in step value to the pointer position register GP or the step value of the pointer position register GP reaches "65" such that the pointer 3 points out the alarm mark 6. Thus, the step value of the pointer position register GP is incremented one by one.

For example, if the switch S3 is operated to set the alarm mode when 12 p.m. is set beforehand as an alarm time in the alarm time register AT, the displays in the pointer display 2 and the digital display 4 are as shown by g in FIG. 8.

In order to update the alarm time in the alarm time register AT after the alarm mode has been set in the manner described above, a switch, for example, S1, other than the switch S3, is operated successively until a desired alarm time is displayed on the digital display 4. In this case, each time the switch S1 is operated, the CPU detects this operation at step S75 of the FIG. 7 to update the alarm time in the alarm time register AT in the switch operation at step S76, so that the new alarm time is displayed on the digital display 4 at step S77.

When the current time becomes equal to the alarm time set in the alarm time register AT in the alarm mode, the CPU detects this fact at step S6 of FIG. 4 in spite of the mode set at that time, and delivers a control signal to the buzzer 20 to cause same to generate a reporting sound for a predetermined duration of time at step S7.

(d) In the stopwatch mode:

In order to change the mode from the alarm mode to the stopwatch mode, the switch S3 is operated in the alarm mode, as shown in FIG. 8. In this case, the CPU detects this operation at step S75 of FIG. 7 and sets the value of the mode register M at 3, which involves the a stopwatch mode in the switching process at step S76. Then, at steps S77–S79 of FIG. 7 control returns through steps S6–S8 of FIG. 4 to the step S1 of FIG. 4, where the CPU determines that the value of the mode register M is already set at 3 and hence that the stopwatch mode has been set. Control then passes to step S5, where the stopwatch mode process is performed in which first the CPU delivers a clear signal c to the stopwatch counter 30 to clear stopwatch time data ST in the stopwatch counter 30, displays the stopwatch time ST (in this case, 0 minutes and 0 seconds since the stopwatch counter 30 is already cleared in the above process) in the stopwatch counter 30 on the digital display 4. The CPU then sets a step value of 70 (at the position of the stopwatch mark 34) in the destination register NP to thereby perform a pointer moving process (steps S27–S31 of FIG. 5). Thereafter, control returns through steps S6–S8 of FIG. 4 to step S1, where the CPU iterates operations similar to those mentioned above until the pointer 3 points out the stopwatch mark 7. Finally, the pointer display 3 and the digital display 4 display data, as shown by h in FIG. 8 (since the pointer 3 has pointed out the stopwatch mark 7 on the pointer display 2, the user can very easily recognize that the stopwatch mode has been set).

When the electronic timepiece measures elapsed time as the stopwatch after the stopwatch mode has been set, as described above, the switch S1 is operated to the start and end of the measurement. At the start of the measurement, in the stopwatch mode process at step S5 of FIG. 4, the CPU delivers a set signal to the RS flip-flop 28 to thereby start the counting operation of the stopwatch counter 30 and hence to display the momentarily changing stopwatch time ST of the stopwatch counter 30 on the display 4. The CPU also delivers a reset signal to the RS flip-flop 28 in the stopwatch mode process (step S5 of FIG. 4) when the measurement is to be ended to thereby stop the stopwatch counter 30.

In order to change the operating mode from the stopwatch mode to the timepiece mode after the operation of the timepiece in the stopwatch mode or the measurement of the stopwatch time ST, the switch S3 is operated, as shown in FIG. 8. Also, in this case, the CPU sets the value of the mode register M at 0 in the stopwatch mode at step S5 of FIG. 4 to set the timepiece mode and thereafter start the operation of the timepiece in the timepiece mode, as described above.

Figure 9:
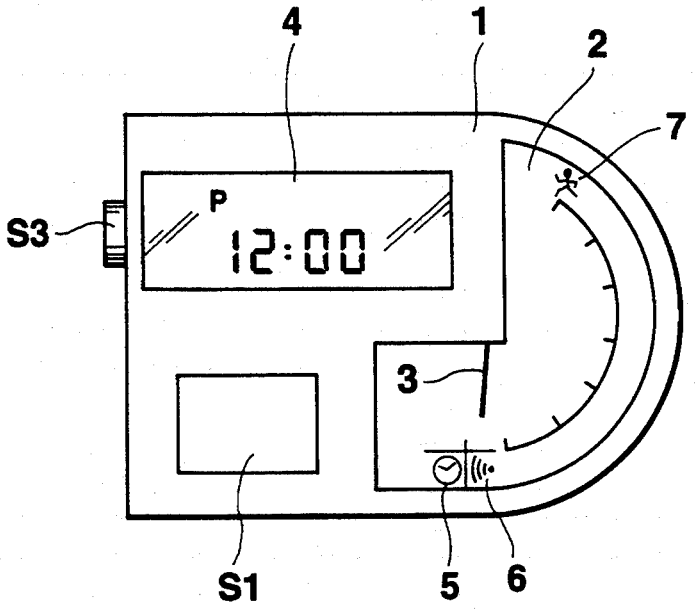
FIG. 9 shows the appearance of a modification of the electronic timepiece according to the present invention.

FIG. 9 shows the appearance of a modification of the electronic timepiece according to the present invention. This modification is different from the FIG. 1 wrist watch in that the arrangement of the pointer display 2, digital display 4 and switch S3 is reversed vertically and horizontally, and that a stopwatch mark indicative of the stopwatch mode is printed at the position of a scale of "0" or a step value of "0" whereas a timepiece mark 5 indicative of a timepiece mode is printed at the position of step S70.

The pointer 3 moves to the position of a step value of 70 in the timepiece mode whereas it moves to the position of a step value of 0 in the stopwatch mode.

Figure 10:
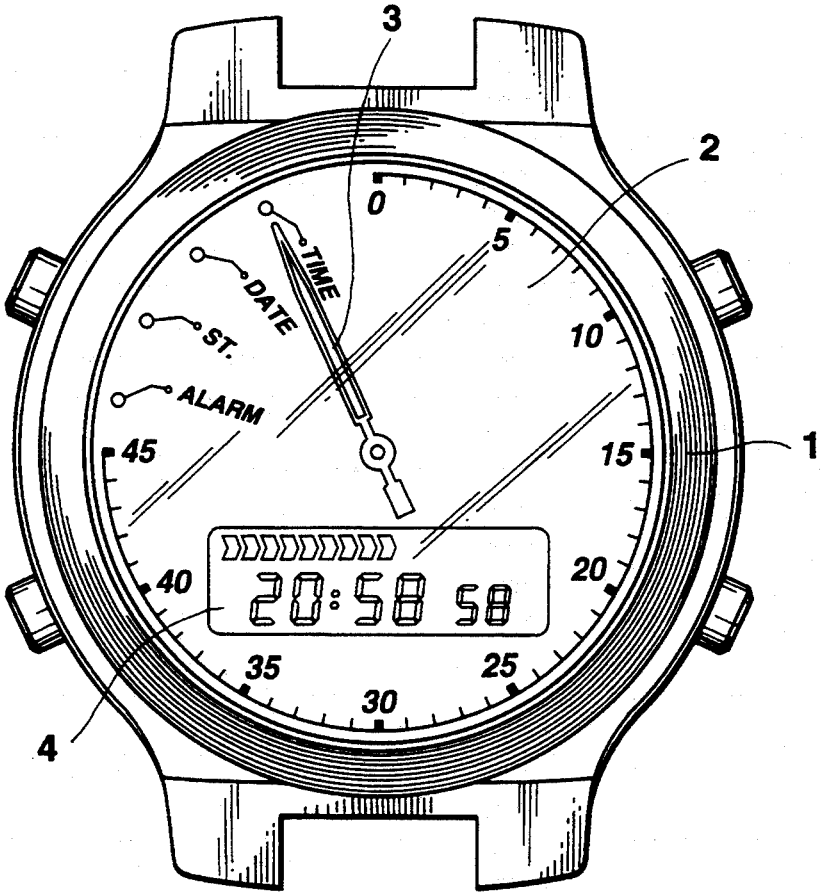
FIG. 10 shows the appearance of another modification of the electronic timepiece.

FIG. 10 shows the appearance of a further modification of the inventive electronic timepiece. In this modification, the whole case 1 is circular and the digital display is provided within the pointer display. In order to indicate a mode in which data is displayed on the digital display, characters are used in place of those marks: that is, "TIME" indicates a current time display mode; "DATE", a date display mode; "ST", a stopwatch mode; and "ALARM", an alarm mode.

While in the above embodiments the current time is displayed on the digital display, arrangement may be such that a pointer is rotated to display the current time in an analog manner.

What is claimed is:

1. An electronic timepiece comprising:

current time display function means for displaying the current time;

a plurality of other function means different from said current time display function means for providing a plurality of different data;

pointer means;

pointer display control means for turning said pointer means within a predetermined range of angles to display data provided by a first at least one of said plurality of other function means;

electro-optical display means for displaying data provided by a second at least one of said plurality of other function means different from said first at least one of said plurality of other function means; and function specifying control means for, when said electro-optical display means displays data provided by said second at least one of said plurality of other function means, moving said pointer means to a predetermined position outside the predetermined range of angles to specify the function of said second at least one of said plurality of other function means.

2. An electronic timepiece according to claim 1, wherein:

said first at least one of said plurality of other function means comprises down timer function means for providing data on the time remaining before a predetermined time; and said pointer means indicates the remaining time.

3. An electronic timepiece according to claim 1, wherein:

said electro-optical display means selectively displays data provided by said plurality of other function means except for said first at least one function mean; and said function specifying control means moves said pointer means to different positions outside said predetermined range of angles corresponding to the respective other function means which provide data displayed by said electro-optical display means.

4. An electronic timepiece according to claim 1, comprising a mark indicative of a function provided at the predetermined position.

5. An electronic timepiece according to claim 1, comprising a character indicative of a function provided at the predetermined position.

6. An electronic timepiece according to claim 1, wherein said function specifying control means comprises control means for moving said pointer means to the boundary of the predetermined range of angles when the data provided by said second at least one of said plurality of other function means is displayed by said electro-optical display means.

7. An electronic timepiece according to claim 1, further comprising:

designating means for designating one of said plurality of other function means selectively; and wherein:

when one of said plurality of other function means is designated selectively by said designating means, said pointer display control means displays data provided by said selectively designated one of said plurality of other function means; and when said one of said plurality of other function means is designated by said designating means, said electro-optical display means displays data provided by said selectively designated one of said plurality of other function means, and said function specifying control means moves said pointer means to a predetermined position outside the predetermined range of angles to indicate the function of said selectively designated one of said plurality of other function means.

8. An electronic timepiece according to claim 1, wherein:

said pointer means is provided so as to be turnable in a range of about 180 degrees; and said electro-optical display means comprises an electro-optical digital display provided opposite the range of about 180 degrees in which said pointer means is provided so as to be turnable.

9. An electronic timepiece according to claim 1, wherein:

said electro-optical display means comprises an electro-optical digital display for displaying data digitally; and said electro-optical digital display is provided so as to overlap with the area of the predetermined range of angles in which said pointer means moves.

10. An electronic timepiece according to claim 1, further comprising a case which encloses the respective parts of said timepiece, and a band attached to said case for bearing said timepiece on a wrist.

11. An electronic timepiece comprising:

current time display function means for displaying the current time;

a plurality of other function means different from said current time display means for providing a corresponding plurality of different data;

other function designating means for selectively designating one of said plurality of other function means;

pointer means;

pointer display control means for, when said other function designating means designates a predetermined one of said plurality of other function means, turning said pointer means within a predetermined range of angles to display data provided by said predetermined one of said plurality of other function means designated by said other function designating means;

electro-optical display means for, when a further one of said plurality of other function means different from said designated predetermined one of said plurality of other function means is designated by said other function designating means, displaying data provided by said designated further other function means; and function specifying control means for, when said further other function means different from said designated predetermined one of said plurality of other function means is designated by said other function designating means, moving said pointer means to a predetermined position outside the predetermined range of angles to indicate the function of said designated further other function means.

12. An electronic timepiece according to claim 11, wherein:

said predetermined one of said plurality of other function means comprises down timer function means for providing data on the interval of time remaining before a predetermined time; and said pointer means indicates the remaining interval of time.

13. An electronic timepiece according to claim 11, wherein:

said electro-optical display means selectively displays an item of data provided by said plurality of other function means different from said predetermined one of said plurality of other function mean; and said function specifying control means moves said pointer means to different positions outside the predetermined range of angles corresponding to the respective other function means which provide data displayed by said electro-optical display means.

14. An electronic timepiece according to claim 11, comprising a mark indicative of a function provided at the predetermined position.

15. An electronic timepiece according to claim 11, comprising a character indicative of a function provided at the predetermined position.

16. An electronic timepiece according to claim 11, wherein said pointer moving control means comprises control means for moving said pointer means to the boundary of the predetermined range of angles when said electro-optical display means displays the data provided by a further one of said plurality of other function means different from said predetermined one of said plurality of other function means.

17. An electronic timepiece according to claim 11, wherein:

said pointer means is provided so as to be turnable in a range of about 180 degrees; and said electro-optical display means comprises an electro-optical digital display provided opposite the range of about 180 degrees in which said pointer means is provided so as to be turnable.

18. An electronic timepiece according to claim 11, further comprising a case which encloses the respective parts of said timepiece, and a band attached to said case for bearing said timepiece on a wrist.

19. An electronic timepiece according to claim 11, wherein:

said electro-optical display means comprises an electro-optical digital display for displaying data digitally; and said electro-optical digital display is provided so as to overlap with the area of the predetermined range of angles in which said pointer means moves.

* * * * *